US005839589A

United States Patent [19]

Hillard

[11] Patent Number: 5,839,589

[45] Date of Patent: Nov. 24, 1998

[54] EQUIPMENT HOLDER

[76] Inventor: Todd H. Hillard, RR #1 Box 67A, Shickshinny, Pa. 18655

[21] Appl. No.: 570,699

[22] Filed: Dec. 11, 1995

[51] Int. Cl.[6] ..... A47F 7/00

[52] U.S. Cl. ..... 211/70.6; 211/99; 211/104; 248/224.7; 248/201

[58] Field of Search ..... 211/106, 87, 70.6, 211/96, 104, 99, 100; 248/224.7, 224.8, 201

[56] References Cited

U.S. PATENT DOCUMENTS

| | | | |
|---|---|---|---|
| 615,264 | 12/1898 | DuPont | 211/104 X |
| 698,272 | 4/1902 | Glover | 211/87 X |
| 1,097,258 | 5/1914 | Noble et al. | 211/87 X |
| 1,580,796 | 4/1926 | Snyder | 211/104 |
| 1,596,346 | 8/1926 | Gibson | 211/104 |
| 2,051,408 | 8/1936 | Karst | 211/106 X |
| 2,530,632 | 11/1950 | Scherstuhl | 211/104 |
| 2,605,906 | 8/1952 | Pontuis | 211/87 X |
| 2,952,366 | 9/1960 | Botten | 211/104 |
| 3,233,745 | 2/1966 | Hershberger | 211/104 |
| 4,852,747 | 8/1989 | Breveglieri . | |
| 5,116,003 | 5/1992 | Gerhardt . | |
| 5,125,517 | 6/1992 | Martinell | 211/18 |
| 5,322,256 | 6/1994 | Kanwischer . | |

*Primary Examiner*—Korie Chan
*Attorney, Agent, or Firm*—Harpman & Harpman

[57] ABSTRACT

A device for holding equipment specifically string-type trimmers and the like between a pair of hanger elements so that the equipment will be suspended therefrom. The hanger elements extend from a mounting plate that is secured to a vertical surface.

3 Claims, 2 Drawing Sheets

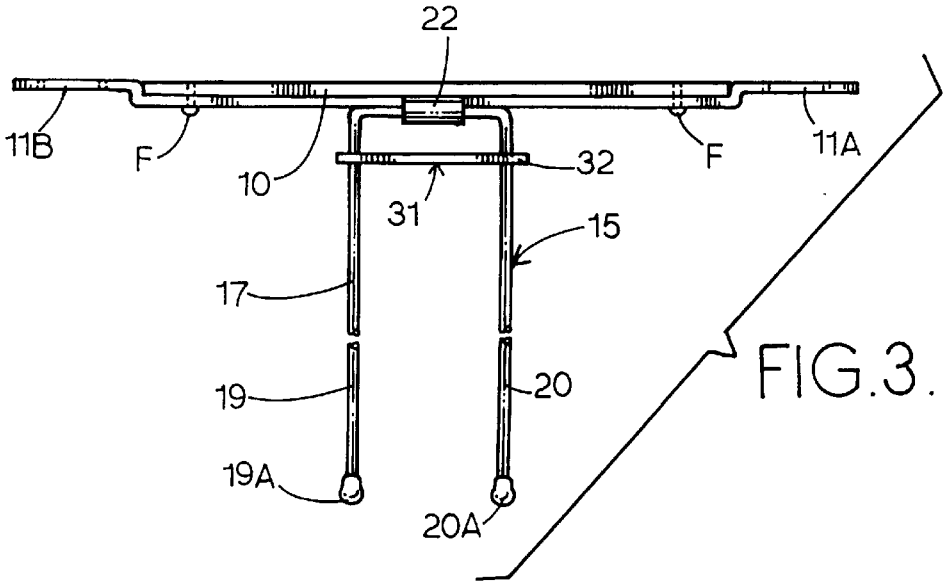
FIG.3.
FIG. 4
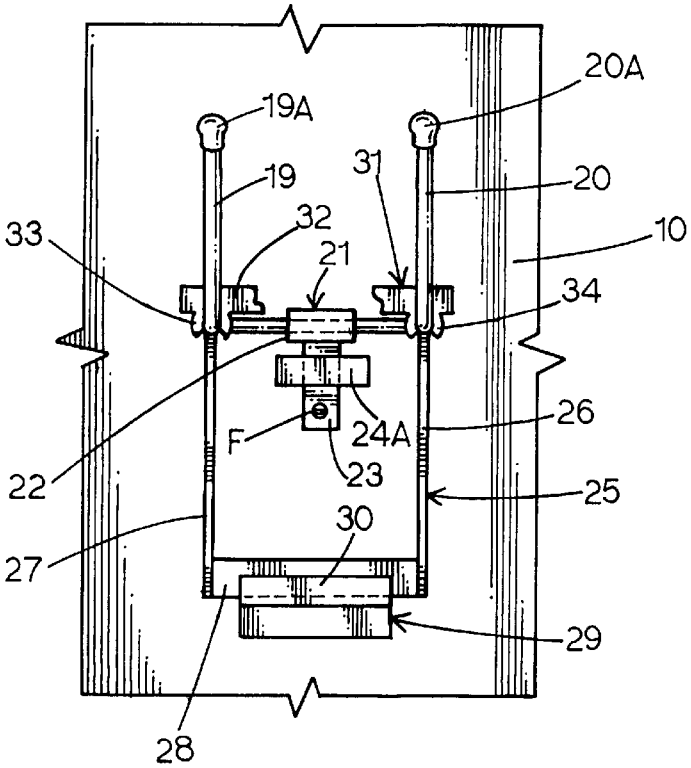

EQUIPMENT HOLDER

BACKGROUND OF THE INVENTION

1. Technical Field

This invention relates to brackets and support structures for tools and power equipment to store them is a safe and easily accessible manner.

2. Description of Prior Art

Prior art devices of this type for supporting articles are well known in the art. Most devices are directed to supporting tools and other related items such as brooms, rakes, saws, etc. Although such equipment hangers are adjustable for storing such related items they are typically incapable of holding articles of increased weight and unusual dimensions. Examples of such heretofore discussed devices are peg boards and multiple tool or gardening implement brackets having multiple extending pegs or elements or short hooks and the like; see for example U.S. Pat. Nos. 4,852,747, 5,116,003, and 5,322,256.

In U.S. Pat. No. 4,852,747 a multiple tool holder is disclosed having an elongated C channel support frame with a plurality of pivoting gripping elements that pivot to wedgeable engage a handle of a tool against a fixed opposing element.

U.S. Pat. No. 5,116,003 is directed to a hanger assembly for different sized and shaped articles. The device has a pair of outwardly extending overlapping inter-engaging brackets to define a scissors-like grasping area therebetween. The engagement force is adjustable by a movable ring extending about the elements.

U.S. Pat. No. 5,322,256 claims a tool holder having a pair of angularly offset bracket elements that pivotally extend from multiple supports crossing one another to form an engagement scissors-like configuration.

SUMMARY OF THE INVENTION

A multipurpose holder for supporting equipment specifically powered string-type trimmers in spaced parallel relation to a wall surface by supporting the equipment from between the ends of a single support element. The support element of the invention safely supports the trimmer between spaced parallel portions in a secure spaced relation to the ground. The holder has dual support and attachment elements for securing same to a variety of wall surfaces and can be selectively adjusted for support characteristics.

DESCRIPTION OF THE DRAWINGS

FIG. 3 is a top plan view thereof; and

FIG. 4 is an enlarged front elevational view of a portion thereof.

DESCRIPTION OF THE PREFERRED EMBODIMENT

Figure 1:
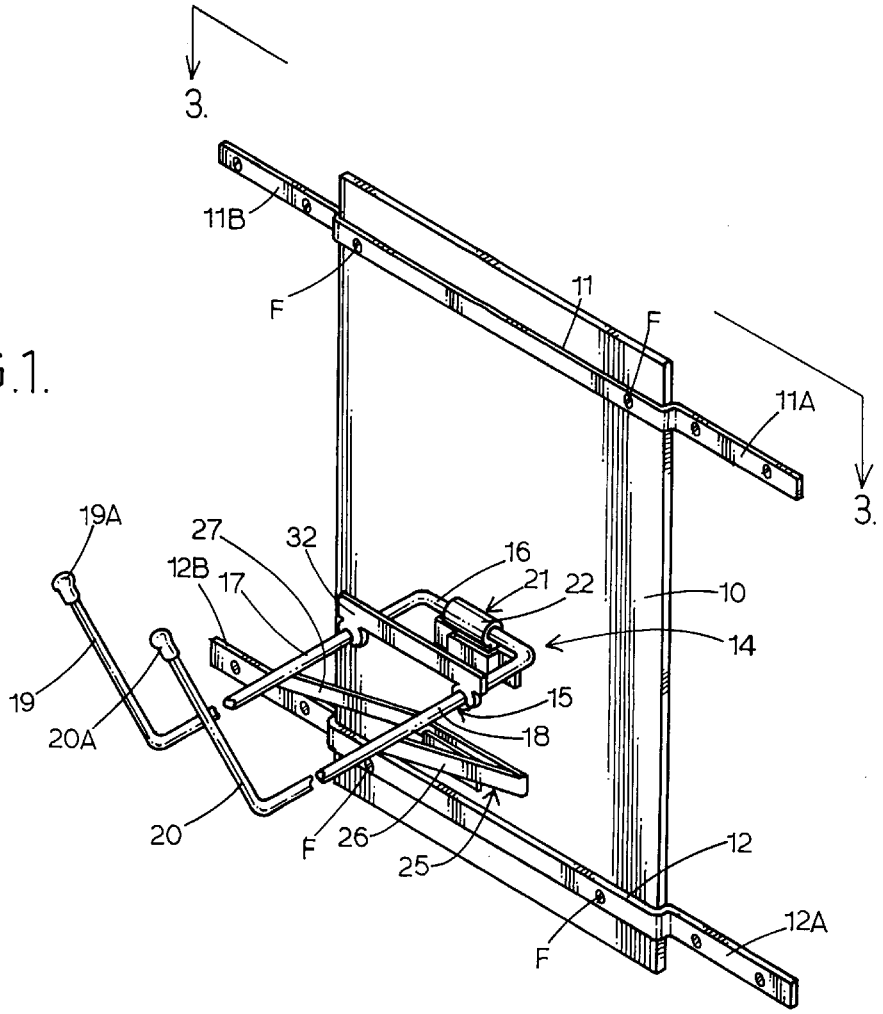
FIG. 1 is a top, front, and side perspective view of the equipment older of the invention.
Figure 2:
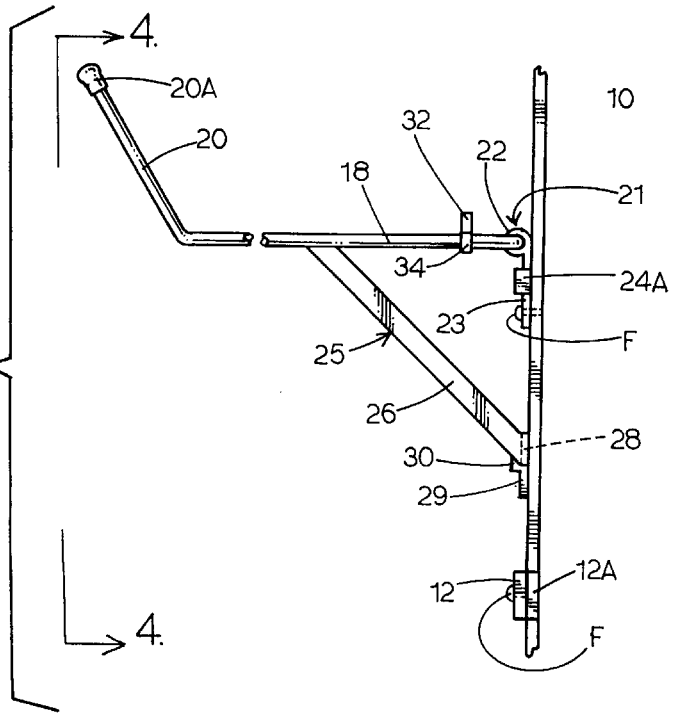
FIG. 2 is a side elevational view of a portion thereof.

Referring to FIGS. 1, 2, and 3 of the drawings, the illustrated equipment hanger comprises a wall support plate 10 of a generally rectangular configuration having a pair of oppositely disposed elongated mounting brackets 11 and 12 extending there across. Each of the mounting brackets 11 and 12 extend across the support plate 10 inwardly of its respective upper and lower ends. The mounting brackets 11 and 12 have apertures angularly offset end portions 11A and 11B and 12A and 12B which are in an aligned planar relation to the support plate 10 when positioned on a wall surface (not shown).

A main equipment support assembly 14 is secured to the mounting plate 10 between said mounting brackets 11 and 12 comprises a generally U shaped wire support element 15 having a base portion 16, spaced parallel outwardly extending engagement portion 17 and 18 with angularly upstanding outwardly extending free end portions 19 and 20. Resilient end caps 19A and 20A are affixed to the free ends of said respective end portions 19 and 20 as here and before described.

The wire support element 15 is removable secured to the support plate 10 by a mounting bracket 21 having a cylindrical wire engagement fitting 22 engagable on the base portion 16 of the wire support element 15.

The cylindrical wire engagement fitting 22 has a offset downwardly extending mounting arm 23 that is registerable with a position slot 24 formed on the support plate 10 by a contoured element 24A. A wire support frame 25 is secured to and extends downwardly from the respective support wire engagement portions 17 and 18.

The wire support frame 25 has wire engagement legs 26 and 27 with a integral interconnecting portion 28 therebetween which is disposed in abutting parallel relation to said support plate 10 best seen in FIG. 2 of the drawings.

A support brace engagement platform 29 best seen in FIGS. 2 and 4 of the drawings extends outwardly from the support plate 10 in vertical spaced relation to said cylindrical wire engagement fitting 22. The platform 29 has an upstanding lip 30 defining an engagement area for the here and before described interconnection portion 28 of the support base 25.

Referring back now to FIGS. 1, 3, and 4 of the drawings, a retaining clip 31 can be seen comprising of an elongated flat bar portion 32 with a pair of oppositely disposed aligned wire engagement clips 33 and 34 extending downwardly there from which are engagable with the respective wire support engagement portion 17 and 18 maintaining same in spaced horizontal relation to one another.

In use an article such as a powered string trimmer (not shown) is positioned in the wire support element 15 between the respective wire engagement portion 17 and 18 and held therein by gravity and the respective upstanding angularly positioned free end portions 19 and 20 of the wire support element 15 as will be well known to those skilled in the art.

The engagement portions 17 and 18 are of a sufficient length to accommodate the bulk of the string trimmer (not shown) is a safe supporting manner. This also allows for ease of access and removal as will be well understood by those skilled in the art.

The retaining clip 31 helps stabilize the wire support element 15 by inter-engaging and holding the wire engagement portion 17 and 18 at preferred lateral spacing from one another.

The wire support frame 25 provides vertical support to the outwardly extending wire support portions 17 and 18 under the effective weight of the equipment to be positioned therein.

When not in use or for transportation the main equipment support assembly 14 can be removed from the support plate 10 by disengaging the mounting bracket 21 from the slot 24 and the support frame 25 interconnecting portion 28 from the base engagement platform 29 thus removing the assembly 14 from the support plate 10.

Thus it will be seen that a new and useful equipment hanger has been illustrated and described and it will be apparent to those skilled in the art that various changes and modifications may be made therein without departing from the spirit of the invention.

Therefore I claim:

1. A hanger for equipment comprises; a support plate, a wire like U-shaped support element removably secured to said support plate, said U-shaped support element having a pair of angularly inclined upstanding free end portions, said angularly inclined upstanding free end portions are in spaced parallel relation to one another, an apertured mounting bracket pivotally secured to said U-shaped support element comprising, a cylindrical wire engagement fitting with a mounting arm extending therefrom registerable in said support plate, a resilient clip extending between said U-shaped support elements and a support frame extending from said U-shaped support elements engageable on said support plate, said support plate having elongated mounting brackets with apertures therealong extending across and beyond said separate support plate.

2. The hanger for equipment set forth in claim 1 wherein said U shaped support element is of a wire-like configuration.

3. The hanger for equipment set forth in claim 1 wherein said support frame comprises; a pair of engagement legs extending from respective article engagement portions of said U shaped support element to a platform on said support plate.

* * * * *